US010567858B2

(12) United States Patent
Han et al.

(10) Patent No.: US 10,567,858 B2
(45) Date of Patent: Feb. 18, 2020

(54) LOUDSPEAKER MODULE AND TERMINAL DEVICE

(71) Applicant: Goertek Inc., Shandong (CN)

(72) Inventors: Dan Han, Shandong (CN); Yun Yang, Shandong (CN); Xinxiang Huo, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/758,028

(22) PCT Filed: May 18, 2016

(86) PCT No.: PCT/CN2016/082498
§ 371 (c)(1),
(2) Date: Mar. 7, 2018

(87) PCT Pub. No.: WO2017/041514
PCT Pub. Date: Mar. 16, 2017

(65) Prior Publication Data

US 2018/0206011 A1 Jul. 19, 2018

(30) Foreign Application Priority Data

Sep. 9, 2015 (CN) ..... 2015 2 0696084 U

(51) Int. Cl.
*H04R 1/02* (2006.01)
*H04R 1/28* (2006.01)

(52) U.S. Cl.
CPC ..... *H04R 1/02* (2013.01); *H04R 1/2842* (2013.01); *H04R 1/2849* (2013.01)

(58) Field of Classification Search
CPC ..... H04R 1/02; H04R 9/06; H04R 2499/11; H04R 2400/11; H04R 2201/34
(Continued)

(56) References Cited

U.S. PATENT DOCUMENTS

2003/0123692 A1* 7/2003 Ueki ..... H04R 1/44 381/398

FOREIGN PATENT DOCUMENTS

CN 202721818 U 2/2013
CN 103347235 A * 10/2013
(Continued)

OTHER PUBLICATIONS

International Searching Authority, International Search Report (ISR) and Written Opinion for International Application No. PCT/CN2016/082498, dated Jul. 26, 2017, 10 pages, State Intellectual Property Office of the P.R.C., China.

*Primary Examiner* — Melur Ramakrishnaiah
(74) *Attorney, Agent, or Firm* — Alston & Bird LLP

(57) ABSTRACT

A loudspeaker module, comprising a housing, and a sounding unit located in an inner cavity of the housing. The sounding unit partitions the inner cavity into a front acoustic cavity and a rear acoustic cavity isolated from each other, a sound hole communicated with the front acoustic cavity being further provided on the housing. The loudspeaker module further comprises a pressure relief channel which communicates the front acoustic cavity with the rear acoustic cavity and is acoustically sealed. The loudspeaker module of the present invention is provided with the pressure relief channel which communicates the front acoustic cavity with the rear acoustic cavity, and the pressure relief channel is acoustically sealed, such that a sound in the front (rear) acoustic cavity cannot be propagated into the rear (front) acoustic cavity so as not to cause an acoustic short circuit; and the rear acoustic cavity is communicated with the front acoustic cavity by means of the pressure relief channel, such that the rear acoustic cavity can balance the air pressure by means of the front acoustic cavity communicated with the outside. The present invention also relates to a terminal
(Continued)

device comprising the loudspeaker module. The waterproof effect of the terminal device is good.

16 Claims, 3 Drawing Sheets

(58) Field of Classification Search
USPC ..... 700/94; 381/345, 353, 354; 181/146, 181/151
See application file for complete search history.

(56) References Cited

FOREIGN PATENT DOCUMENTS

| | | | |
|---|---|---|---|
| CN | 103347235 | A | 10/2013 |
| CN | 103826179 | A | 5/2014 |
| CN | 204906708 | U | 12/2015 |
| CN | 105516870 | A | 4/2016 |
| WO | WO 2015/015004 | A1 | 2/2015 |

* cited by examiner

LOUDSPEAKER MODULE AND TERMINAL DEVICE

CROSS-REFERENCE TO RELATED APPLICATIONS

This application is a National Stage of International Application No. PCT/CN2016/082498, filed on May 18, 2016, which claims priority to Chinese Patent Application No. 201520696084.7, filed on Sep. 9, 2015, both of which are hereby incorporated by reference in their entireties.

BACKGROUND

Technical Field

The present invention relates to the field of sounding devices, and more particularly to a loudspeaker module and a terminal device.

Description of Related Art

Speakers are important acoustic components in electronic devices, which are transducing devices that convert electrical signals into acoustic signals. An existing loudspeaker module comprises a housing and a sounder unit disposed in the housing, the sounder unit dividing an inner cavity of the housing into a front acoustic cavity and a rear acoustic cavity that are isolated from each other. The front acoustic cavity communicates with a sound hole of the loudspeaker module.

The loudspeaker module, in order to adapt to different atmospheric conditions, is usually provided with a pressure relief hole communicating with the rear acoustic cavity and the outside, so as to maintain the air pressure in the rear acoustic cavity and the external air pressure to be equal. In a conventional structure, the rear acoustic cavity communicates with the interior space of a terminal electronic device through the pressure relief hole, and the terminal electronic device communicates with the outside. Therefore, such a structure can realize the communication between the rear acoustic cavity and the outside to achieve air pressure equalization. The current terminal electronic devices, such as cell phones, need to be strictly waterproof. The interior space of such a waterproof terminal is basically completely sealed. If the interior space of the terminal is sealed, it is difficult to ensure complete air pressure equalization between the terminal and the outside. If the pressure relief hole is arranged on the surface of the housing communicating with the rear acoustic cavity, the purpose of communicating with the outside cannot be achieved, and it is difficult to realize air pressure equalization.

In addition, the pressure relief hole is generally designed on the outer surface of the module. On one hand, this affects the appearance of the loudspeaker module, and on the other hand, the sound relief hole is easily blocked or damaged when cooperating with a terminal product (such as a mobile phone, a computer, etc.).

BRIEF SUMMARY

An object of the present invention is to provide a loudspeaker module.

According to one aspect of the present invention, there is provided a loudspeaker module, comprising: a housing and a sounding unit which is arranged in an inner cavity of the housing, wherein the sounding unit divides the inner cavity into a front acoustic cavity and a rear acoustic cavity isolated from each other, and the housing is further provided with a sound hole communicating the front acoustic cavity with the external environment; and the loudspeaker module further comprises an pressure relief channel which communicates the front acoustic cavity with the rear acoustic cavity and is acoustically sealed.

Preferably, the pressure relief channel is arranged on a partition plate for partitioning the front acoustic cavity and the rear acoustic cavity.

Preferably, the sounding unit comprises a vibration diaphragm; and the pressure relief channel is located between the vibration diaphragm and the sound hole.

Preferably, the pressure relief channel comprises a through hole penetrating through the partition plate, and one side of the partition plate is provided with a damping screen covering the through hole.

Preferably, a groove for accommodating the damping screen is further provided on the partition plate at the position of the through hole.

Preferably, the damping screen is arranged on one side of the partition plate adjacent to the front acoustic cavity.

Preferably, one side of the partition plate opposite to the damping screen is further provided with a pressure relief groove communicating with the through hole, the pressure relief groove is distributed along an end surface of the partition plate, and a cover plate covering the through hole and part of the pressure relief groove is also provided for the partition plate.

Preferably, a boss is provided on the partition plate at the position of the through hole, the pressure relief groove is disposed on an end surface of the boss and has its one end connected to the through hole and extending from the through hole to its other end along the end surface of the boss, and the cover plate covers the end face of the boss.

Preferably, a limiting flange extending upwards is respectively arranged on each side of the boss.

Preferably, the housing comprises an upper housing, a middle housing and a lower housing which are sequentially buckled together.

Preferably, the partition plate is arranged on the middle housing.

The loudspeaker module of the present invention is provided with a pressure relief channel which communicates with the front acoustic cavity and the rear acoustic cavity and which is acoustically sealed. The rear acoustic cavity communicates with the front acoustic cavity through the pressure relief channel so that the rear acoustic cavity can realize air pressure equalization through the front acoustic cavity communicating with the outside in order to ensure air pressure equalization between the rear acoustic cavity and the outside, so that it can adapt to different atmospheric conditions. The loudspeaker module of the present invention does not need to separately provide a pressure relief channel at the position of the rear acoustic cavity and can achieve air pressure equalization though the communication between the pressure relief channel and the front acoustic cavity even if the interior space of a terminal device is completely sealed based on the waterproof requirement. Secondly, since the loudspeaker module of the present invention does not need to separately provide a pressure relief hole communicating with the outside at the position of the rear acoustic cavity, the appearance of the whole module is neat and the pressure relief hole will not be damaged or clogged.

According to another aspect of the present invention, there is provided a terminal device, comprising a terminal device housing and a holding cavity surrounded by the terminal device housing, wherein the holding cavity is a sealed space for accommodating a loudspeaker module mentioned above; the front acoustic cavity of the loudspeaker module communicates with the external environment through the sound hole; and the rear acoustic cavity communicates with the external environment through the pressure relief channel and the front acoustic cavity.

In the terminal device of the present invention, since only the sound hole of the front acoustic cavity of the loudspeaker module in the holding cavity communicates with the outside, the rear acoustic cavity eliminates the pressure relief structure in the conventional structure and the loudspeaker module is more independent and therefore more advantageous for the sealing of the terminal device. That is, a substantially completely sealed state within the holding cavity can be realized, thereby optimizing its dust-proof, waterproofing performance and so on, and providing the terminal device with better audio performance.

Further features of the present invention, as well as advantages thereof, will become apparent from the following detailed description of exemplary embodiments of the present invention with reference to the attached drawings.

BRIEF DESCRIPTION OF THE FIGURES

The accompanying drawings, which are incorporated in and constitute a part of the specification, illustrate embodiments of the present invention and, together with the description, serve to explain the principles of the invention.

BRIEF DESCRIPTION OF THE VARIOUS EMBODIMENTS

Various exemplary embodiments of the present invention will now be described in detail with reference to the accompanying drawings. It should be noted that the relative arrangement of the components and steps, numerical expressions and numerical values set forth in these embodiments do not limit the scope of the present invention unless it is specifically stated otherwise.

The following description of at least one exemplary embodiment is merely illustrative in nature and by no means is to be construed as any limitation on the present invention and its application or use.

The techniques and equipment known to one of ordinary skill in the relevant art may not be discussed in detail, but where appropriate the techniques and equipment should be considered as part of the description.

In all of the examples shown and discussed herein, any specific value should be interpreted as merely illustrative and not as a limitation. Therefore, other examples of the exemplary embodiments may have different values.

It should be noted that like reference numbers and letters designate similar terms in the following figures, and therefore, an item need not be further discussed in subsequent figures as soon as an item is defined in a drawing.

Figure 1:
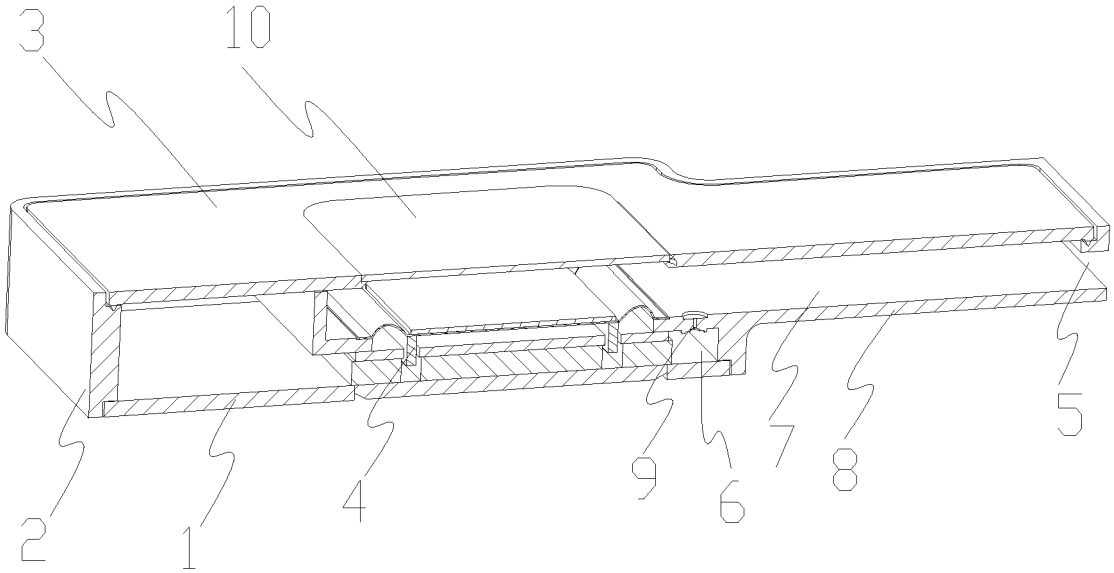
FIG. 1 is a cross-sectional view of a loudspeaker module of the present invention.

Referring to FIG. 1, the present invention provides a loudspeaker module, which comprises a housing and an inner cavity in the housing for accommodating a sounding unit 4. In a specific embodiment of the present invention, the housing comprises an upper housing 3, a middle housing 2 and a lower housing 1 sequentially buckled together. After the upper housing 3, the middle housing 2 and the lower housing 1 are buckled together, the inner cavity for accommodating the sounding unit 4 is formed. The sounding unit 4 divides the internal cavity of the housing into a front acoustic cavity 7 and a rear acoustic cavity 6 isolated from each other. Specifically, a vibration diaphragm of the sounding unit 4 divides the space inside the loudspeaker module into the front acoustic cavity 7 and the rear acoustic cavity 6. The front acoustic cavity 7 is communicated with the external environment by a sound hole 5 of the loudspeaker module, and the rear acoustic cavity 6 is a closed structure. In application, in order to increase the interior space of the loudspeaker module so as to increase the size of the sounding unit and obtain a better sounding effect, steel plates 10 usually replace some positions of the upper housing 3. At the time of forming the upper housing 3, the steel sheet 10 is injection-molded in the manner of an insert. Due to the lightness of the metal material, the steel sheet 10 is thinner than other positions of the upper housing 3, thereby increasing the interior space of the loudspeaker module.

The sounding unit 4 comprises a magnetic circuit system and a vibration system. The magnetic circuit system comprises a basin frame which is arranged in the inner cavity and a magnet which is arranged in the basin frame. A gap is arranged between the magnet and a sidewall of the basin frame. The magnet is also provided with a washer, etc. The vibration system comprises a vibration diaphragm 41 fixed in the inner cavity and a voice coil for driving the vibration diaphragm 41 to sound. The voice coil is fixed on the vibration diaphragm 41 and is suspended in the gap between the magnet and the side wall of the frame. The center of the vibration diaphragm 41 is provided with a dome or the like.

After the voice coil is energized, the voice coil will be vibrated by an ampere force under the action of the magnetic field of the magnetic circuit system. At the same time, the voice coil drives the vibration diaphragm to vibrate together to realize the sounding of the vibration diaphragm. The housing is further provided with a sound hole 5 communicating the front acoustic cavity 7 with the external environment so that the sound emitted by the vibration diaphragm can flow from the sound hole 5 to the outside. The above structure belongs to common general knowledge of a person skilled in the art and will not be described in detail herein.

The loudspeaker module of the present invention further comprises a pressure relief channel 9 that communicates with the front acoustic cavity 7 with the rear acoustic cavity 6 and that is acoustically sealed. The front acoustic cavity 7 can communicate with the rear acoustic cavity 6 through the relief channel 9 so that the rear acoustic cavity 6 can achieve air pressure equalization through the front acoustic cavity 7 communicating with the outside. That is to say, the rear acoustic cavity 6 communicates with the outside through the relief channel 9, the front acoustic cavity 7 and the sound hole 5, so as to keep consistency with the external air pressure.

In the loudspeaker module of the present invention, the pressure relief channel 9 is acoustically sealed. For those skilled in the art, being acoustically sealed means that it is in an acoustically sealed state. That is to say, the sound waves are not allowed to pass through. The pressure relief channel 9 is acoustically sealed. That is, the sound in the front acoustic cavity 7 will not enter the rear acoustic cavity 6 through the pressure relief channel 9, and the sound in the rear acoustic cavity 6 will not pass through the pressure relief channel 9 and enter the front acoustic cavity 7 so as to ensure sound isolation between the front acoustic cavity 7 and the rear acoustic cavity 6 and prevent acoustic short circuits and failure of the loudspeaker module.

In a specific embodiment of the present invention, referring to FIG. 1, a partition plate 8 is provided on the middle housing 2. The sounding unit 4 is fixed on the partition plate 8. The sounding unit 4, together with the partition plate 8, divides the inner cavity of the housing into a front acoustic cavity 7 and a rear acoustic cavity 6. The pressure relief channel 9 is provided on the partition plate 8. Further, the relief channel is located between the vibration diaphragm 41 and the sound hole 5. Of course, for those skilled in the art, the pressure relief channel 9 can be arranged on any part separating the front acoustic cavity 7 and the rear acoustic cavity 6.

The acoustic sealing of the pressure relief channel 9 can be achieved by means well known to those skilled in the art such as by making the pressure relief channel 9 very small or by other known means to increase the damping of the pressure relief channel 9 and making the same as a damping hole structure, so that the sound can be prevented from propagating in the relief channel 9.

Figure 2:
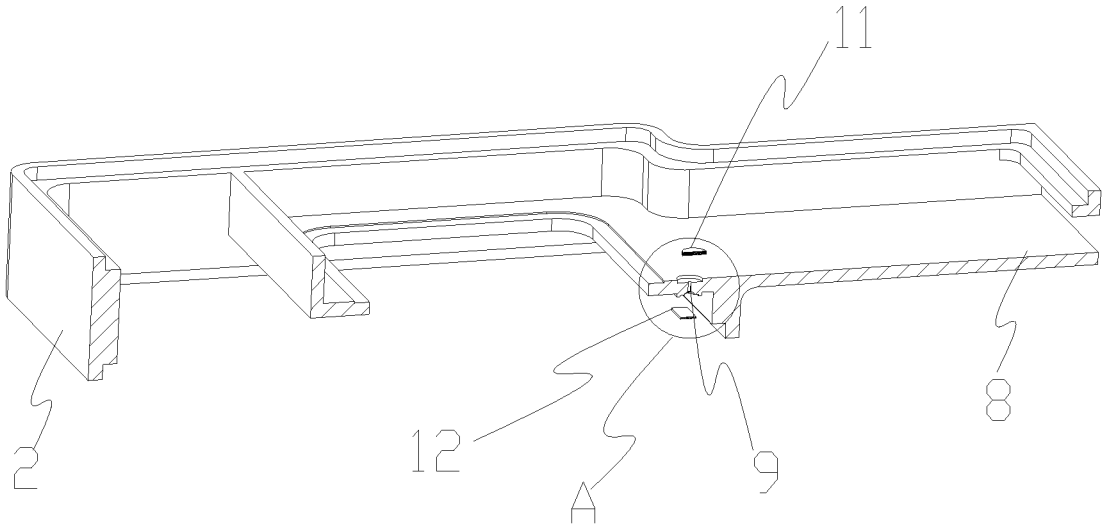
FIG. 2 is a structural diagram of the housing in FIG. 1.
Figure 3:
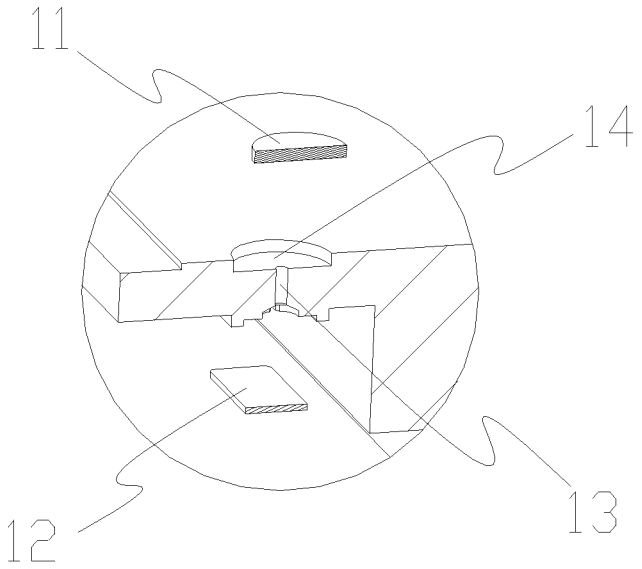
FIG. 3 is a partial enlarged view of the position A in FIG. 2.

In a specific embodiment of the present invention, referring to FIGS. 2 and 3, the pressure relief channel 9 comprises a through hole 13 penetrating the partition plate 8. On one side of the partition plate 8, a damping screen 11 covering the through hole 13 is provided. The damping screen 11 may be provided on one side of the partition plate 8 adjacent to the rear acoustic cavity 6 and preferably on one side of the partition plate 8 adjacent to the front acoustic cavity 7. By means of the damping screen 11, the damping effect of the through hole 13 can be improved so as to realize the acoustic sealing of the front acoustic cavity 7 and the rear acoustic cavity 6.

Of course, for those skilled in the art, adjusting the pitch of the mesh holes in the damping screen 11 can achieve the purpose of adjusting its damping. In the present invention, the damping screen 11 is also arranged to prevent foreign matter from entering the rear acoustic cavity 6.

The damping screen 11 according to the present invention can be fastened to the partition plate 8, for example attached to the partition plate 8, by means well-known to those skilled in the art. Further preferably, a groove 14 is further disposed on the partition plate 8 at the position of the through hole 12. The shape of the groove 14 is matched with the outer contour of the damping screen 11. The damping screen 11 can be attached to the groove 14 to achieve a secure connection of the damping screen 11 to the partition plate 8.

Figure 4:
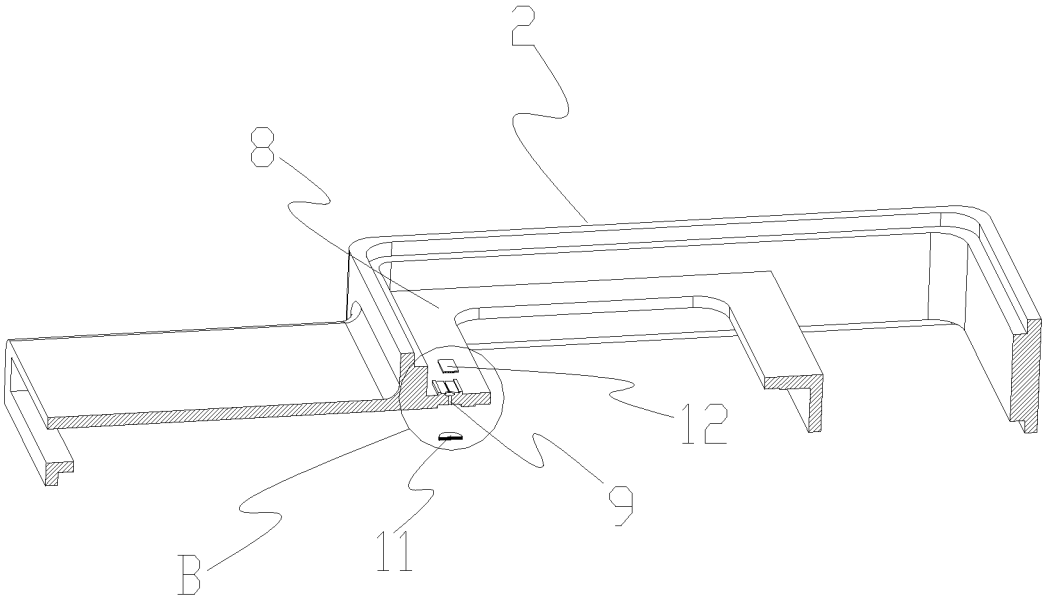
FIG. 4 is a schematic structural view of the other side of the housing in FIG. 2.
Figure 5:
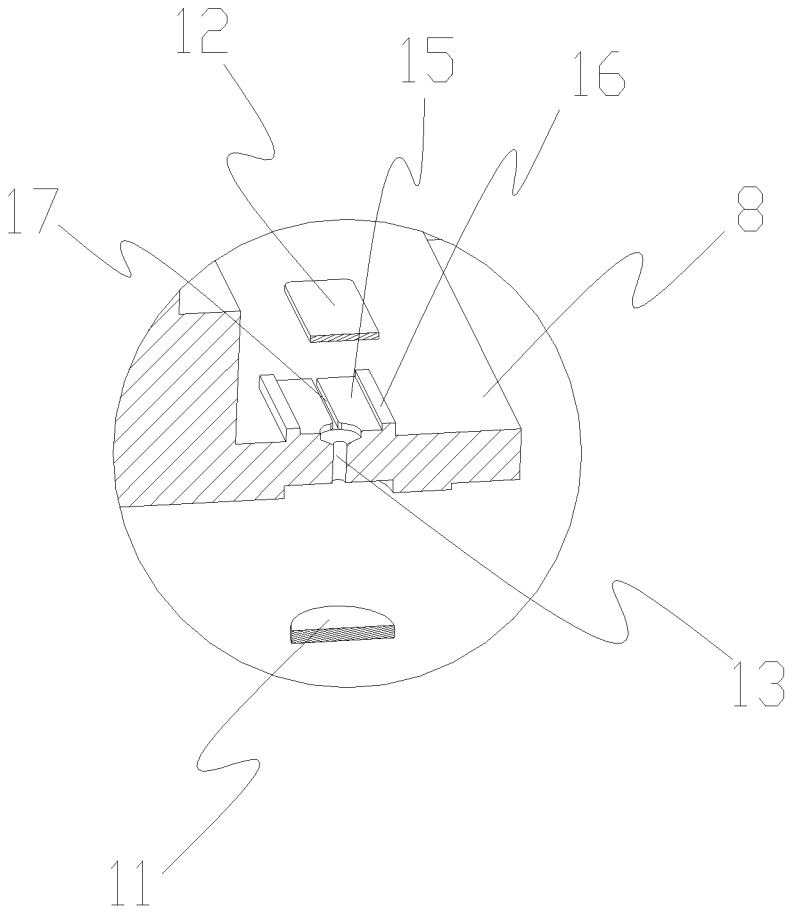
FIG. 5 is a partial enlarged view of the position B in FIG. 4.

In another embodiment of the present invention, a pressure relief groove 17 communicating with the through hole 13 is also provided on a side of the partition plate 8 opposite to the damping screen 11, referring to FIGS. 4 and 5. The pressure relief groove 17 is provided on an end face of the partition plate 8. That is, one end of the pressure relief groove 17 communicates with the through hole 13, and the other end thereof extends along the end face of the partition plate 8. A cover plate 12 that covers the through hole 13 and part of the pressure relief groove 17 is further provided on the end surface of the partition plate 8. The cover plate 12 may be a plastic plate that is fixed to the partition plate 8 and covers the through hole 13 and part of the pressure relief groove 17 so that the through hole 13, the pressure relief groove 17 and the cover plate 12 form the pressure relief channel 9 described above. The pressure relief grooves 17 are distributed on the end face of the partition plate 8, so as to increase the length of the pressure relief channel 9 and improve the damping effect of the pressure relief channel 9.

Preferably, as shown in FIGS. 4 and 5, a boss 15 is disposed on the partition plate 8 at the position of the through hole 13. The pressure relief groove 17 is disposed on an end surface of the boss 15, one end of which is connected to the through hole 13 and extends straight along the end surface of the boss 15 from the through hole 13 so that the other end projects from the end of the boss 15. The cover plate 12 covers the end surface of the boss 15, thereby blocking the through-hole 13 and the pressure relief groove 17. Of course, only one preferred embodiment is shown in the figures. In a specific implementation, the design of the pressure relief groove 17 is not limited to such a structure. For example, one end of the pressure relief groove 17 is connected to the through hole 13 and extends to the other end thereof from the through hole 13 along the end surface of the boss 15, which specifically can bend and extend along the end surface of the boss 15. In this embodiment, the other end of the pressure relief groove 17 does not exceed the end of the boss 15. It can be easily understood that in this case, the cover plate 12 cannot completely block the pressure relief groove 17. The pressure relief groove 17 extends on the end surface of the boss 15 so that the pressure relief groove 17 can be made long enough to increase the damping of the entire pressure relief channel 9 and thus achieve acoustic sealing of the front acoustic cavity 7 and the rear acoustic cavity 6. Further preferably, both sides of the boss 15 are respectively provided with an upward limiting flange 16, so as to limit the cover 12.

The loudspeaker module of the present invention is provided with a pressure relief channel communicating with the front acoustic cavity and the rear acoustic cavity. The pressure relief channel is acoustically sealed so that the sound in the front acoustic cavity will not propagate into the rear acoustic cavity. The rear acoustic cavity communicates with the front acoustic cavity through the pressure relief channel so that the rear acoustic cavity can realize air pressure equalization through the front acoustic cavity communicating with the outside to ensure air pressure equalization between the rear acoustic cavity and the outside. In the loudspeaker module of the present invention, the pressure relief channel 9 is disposed on the partition plate 8 located in the interior space of the loudspeaker module. Because the front acoustic cavity directly communicates with the outside, the pressure relief channel 9 can communicate with the outside by communicating with the front acoustic cavity and thus can be applied to a waterproof electronic device with an almost sealed interior space. In addition, this kind of design does not need to separately provide a pressure relief hole structure for communicating with the outside at the position of the rear acoustic cavity, so that the whole loudspeaker module looks neat and clean and there will be no pressure relief hole damage or blockage problems.

Figure 6:
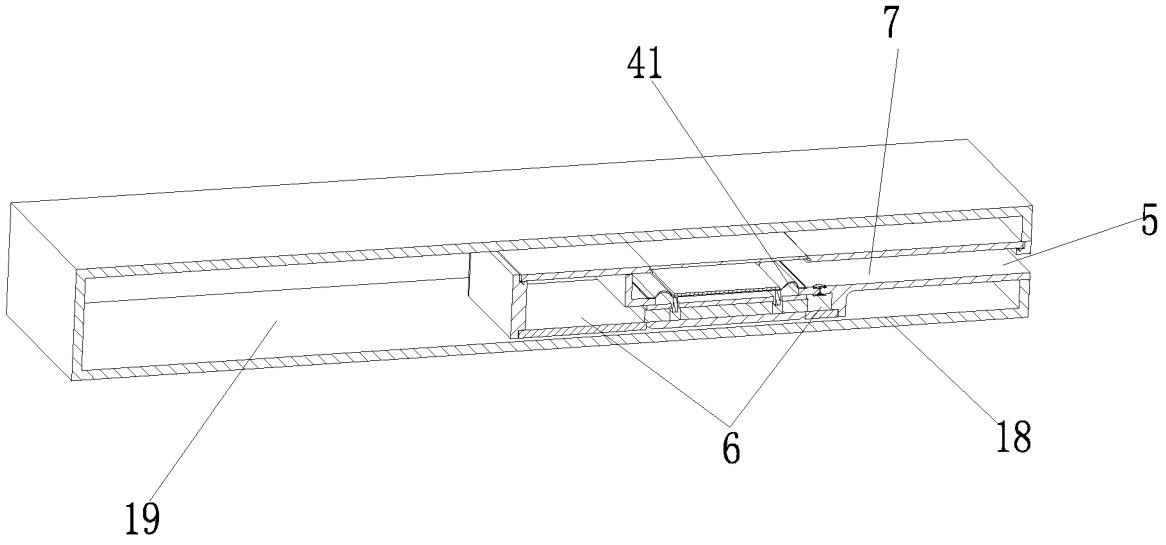
FIG. 6 is a schematic diagram of the loudspeaker module of the present invention applied to a terminal device.

FIG. 6 shows a structure of the above loudspeaker module applied to a terminal device including a terminal device housing 18 and a holding cavity 19 surrounded by the terminal device housing 18. In the present invention, the holding cavity of the terminal device 19 is a substantially completely sealed space based on waterproof needs. The loudspeaker module is accommodated in the holding cavity 19. It can be seen that in this structure, the front acoustic cavity 7 of the loudspeaker module communicates with the outside through the sound hole 5. The rear acoustic cavity 6 and the holding cavity 19 of the terminal device are two independent cavities, which communicate with the front acoustic cavity 7 mainly through the pressure relief channel 9 and communicate with the external environment through the front acoustic cavity 7 so as to achieve air pressure equalization. At this point, the terminal device can be optimal in waterproof effects.

Although some specific embodiments of the present invention have been described in detail by way of example, those skilled in the art should understand that the above examples are only for the purpose of illustration and are not intended to limit the scope of the present invention. It will be understood by those skilled in the art that the above embodiments may be modified without departing from the scope and spirit of the invention. The scope of the invention is defined by the appended claims.

What is claimed is:

1. A loudspeaker module, comprising:

a housing;

a sounding unit arranged in an inner cavity of the housing, wherein the sounding unit divides the inner cavity into a front acoustic cavity and a rear acoustic cavity isolated from each other, and wherein the housing is further provided with a sound hole communicating the front acoustic cavity with the external environment; and a pressure relief channel communicates the front acoustic cavity with the rear acoustic cavity and is acoustically sealed, wherein:

the pressure relief channel is arranged on a partition plate for partitioning the front acoustic cavity and the rear acoustic cavity; and the pressure relief channel comprises a through hole penetrating through the partition plate, and one side of the partition plate is provided with a damping screen covering the through hole.

2. The loudspeaker module according to claim 1, wherein the sounding unit comprises a vibration diaphragm, and the pressure relief channel is located between the vibration diaphragm and the sound hole.

3. The loudspeaker module according to claim 1, wherein a groove for accommodating the damping screen is further provided on the partition plate at the position of the through hole.

4. The loudspeaker module according to claim 1, wherein the damping screen is arranged on one side of the partition plate adjacent to the front acoustic cavity.

5. The loudspeaker module according to claim 1, wherein one side of the partition plate opposite to the damping screen is further provided with a pressure relief groove communicating with the through hole, the pressure relief groove is distributed along an end surface of the partition plate, and a cover plate covering the through hole and part of the pressure relief groove is also provided for the partition plate.

6. The loudspeaker module according to claim 5, wherein a boss is provided on the partition plate at the position of the through hole, the pressure relief groove is disposed on an end surface of the boss and has its one end connected to the through hole and extending from the through hole to its other end along the end surface of the boss, and the cover plate covers the end face of the boss.

7. The loudspeaker module according to claim 6, wherein a limiting flange extending upwards is respectively arranged on each side of the boss.

8. The loudspeaker module according to claim 1, wherein the housing comprises an upper housing, a middle housing and a lower housing which are sequentially buckled together.

9. The loudspeaker module according to claim 8, wherein the partition plate is arranged on the middle housing.

10. A terminal device, comprising:

a terminal device housing; and a holding cavity surrounded by the terminal device housing, wherein:

the holding cavity is a sealed space for accommodating a loudspeaker module comprising a loudspeaker module housing, a sounding unit arranged in an inner cavity of the loudspeaker module housing, and a pressure relief channel, the sounding unit divides the inner cavity into a front acoustic cavity and a rear acoustic cavity isolated from each other, the loudspeaker module housing is further provided with a sound hole communicating the front acoustic cavity with the external environment, the pressure relief channel communicates the front acoustic cavity with the rear acoustic cavity and is acoustically sealed, the rear acoustic cavity communicates with the external environment through the pressure relief channel and the front acoustic cavity;

the pressure relief channel is arranged on a partition plate for partitioning the front acoustic cavity and the rear acoustic cavity; and the pressure relief channel comprises a through hole penetrating through the partition plate, and one side of the partition plate is provided with a damping screen covering the through hole.

11. The terminal device according to claim 10, wherein the sounding unit comprises a vibration diaphragm, and the pressure relief channel is located between the vibration diaphragm and the sound hole.

12. The terminal device according to claim 10, wherein a groove for accommodating the damping screen is further provided on the partition plate at the position of the through hole.

13. The terminal device according to claim 10, wherein the damping screen is arranged on one side of the partition plate adjacent to the front acoustic cavity.

14. The terminal device according to claim 10, wherein one side of the partition plate opposite to the damping screen is further provided with a pressure relief groove communicating with the through hole, the pressure relief groove is distributed along an end surface of the partition plate, and a cover plate covering the through hole and part of the pressure relief groove is also provided for the partition plate.

15. The terminal device according to claim 14, wherein a boss is provided on the partition plate at the position of the through hole, the pressure relief groove is disposed on an end surface of the boss and has its one end connected to the through hole and extending from the through hole to its other end along the end surface of the boss, and the cover plate covers the end face of the boss, and wherein a limiting flange extending upwards is respectively arranged on each side of the boss.

16. The terminal device according to claim 10, wherein the housing comprises an upper housing, a middle housing and a lower housing which are sequentially buckled together, and wherein the partition plate is arranged on the middle housing.

* * * * *